US007553217B2

(12) United States Patent
Reich et al.

(10) Patent No.: US 7,553,217 B2
(45) Date of Patent: Jun. 30, 2009

(54) DUST-COLLECTING CONTAINER FOR A HAND ELECTRIC MACHINE TOOL

(75) Inventors: Doris Reich, Stuttgart (DE); Steffen Wuensch, Holzgerlingen (DE); Tobias Lutz, Filderstadt (DE); Christoph Cramer, Aichtal (DE)

(73) Assignee: Robert Bosch GmbH, Stuttgart (DE)

( * ) Notice: Subject to any disclaimer, the term of this patent is extended or adjusted under 35 U.S.C. 154(b) by 132 days.

(21) Appl. No.: 10/517,417

(22) PCT Filed: Jul. 4, 2003

(86) PCT No.: PCT/DE03/02240

§ 371 (c)(1),
(2), (4) Date: Dec. 8, 2004

(87) PCT Pub. No.: WO2004/039539

PCT Pub. Date: May 13, 2004

(65) Prior Publication Data

US 2005/0202767 A1 Sep. 15, 2005

(30) Foreign Application Priority Data

Oct. 22, 2002 (DE) ..... 102 49 140

(51) Int. Cl.
*B24B 23/00* (2006.01)

(52) U.S. Cl. ..... 451/344; 451/453

(58) Field of Classification Search ..... 451/344, 451/451, 453

See application file for complete search history.

(56) References Cited

U.S. PATENT DOCUMENTS 1,412,725 A * 4/1922 Vernon ..... 451/358
1,800,341 A * 4/1931 Davies ..... 451/354
2,439,596 A * 4/1948 Crosby ..... 451/344
3,926,595 A * 12/1975 Bockman ..... 55/302
4,124,956 A * 11/1978 Levinson ..... 451/456
4,360,432 A * 11/1982 Kieronski ..... 210/402
4,435,877 A * 3/1984 Berfield ..... 15/326
4,655,694 A * 4/1987 Berfield ..... 417/423.2
4,675,032 A 6/1987 Genovese et al.
4,675,999 A * 6/1987 Ito et al. ..... 30/124
4,967,516 A * 11/1990 Hoshino et al. ..... 451/359

(Continued)

FOREIGN PATENT DOCUMENTS

DE 02 06 123 * 9/1980

(Continued)

*Primary Examiner*—Maurina Rachuba
(74) *Attorney, Agent, or Firm*—Michael J. Striker

(57) ABSTRACT

A dust-collecting receptacle for an electric hand machine tool, in particular an electric hand grinder, having a dust-collecting chamber (17), an inlet fitting (21), an exhaust opening (18), and a dust filter (20) situated between the dust-collecting chamber (17) and the exhaust opening (18). To achieve a compact design of the dust-collecting receptacle (14) that on the one hand, does not impair operation of the electric hand grinder or only does so to an insignificant degree and on the other hand, has a high dust-collecting efficiency, the inlet fitting (21), the dust-collecting chamber (17), the dust filter (20), and the exhaust opening (18) are situated one above another and preferably, the form of the dust-collecting receptacle (14) is adapted to the outer contour of the electric hand machine tool (FIG. 1).

10 Claims, 2 Drawing Sheets

Figure 1:
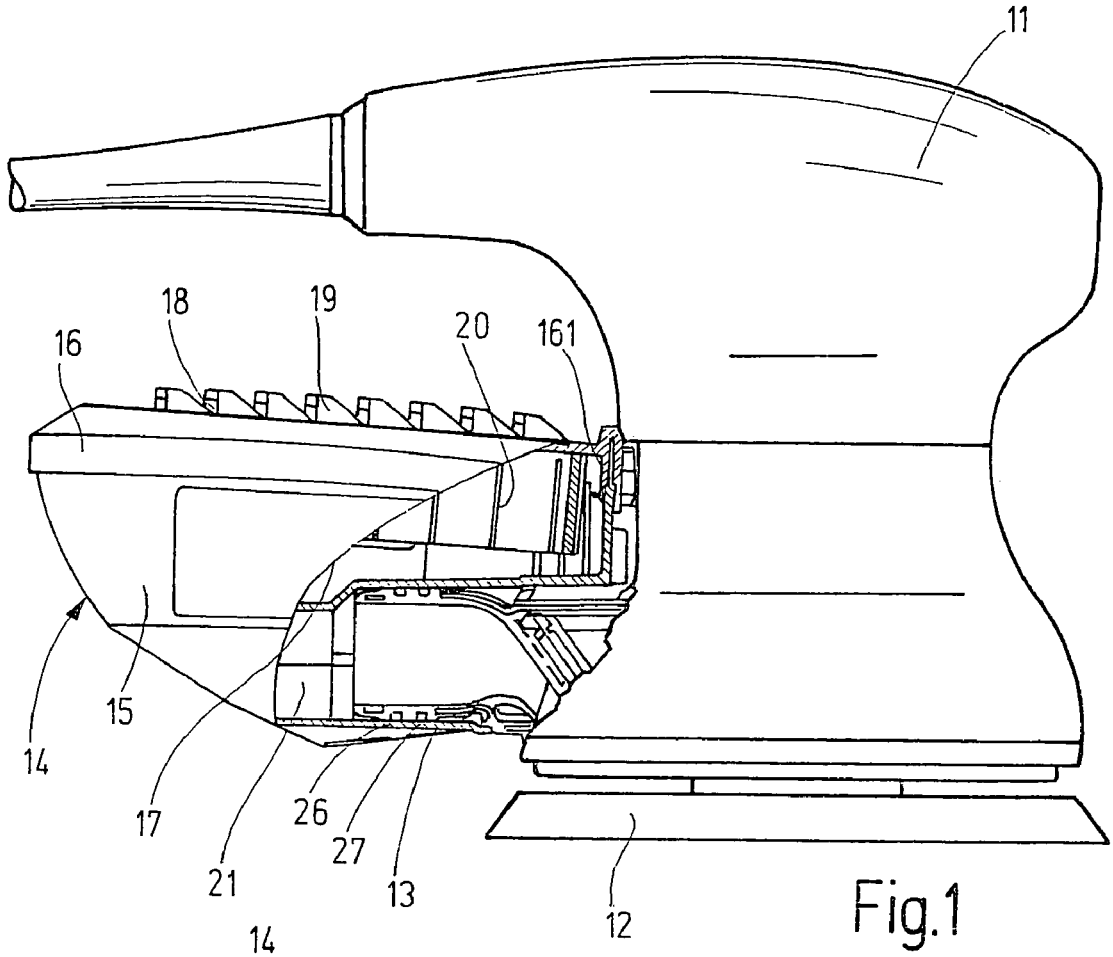

U.S. PATENT DOCUMENTS 5,297,363 A * 3/1994 Schroder et al. ..... 451/358
5,335,049 A * 8/1994 Kanai et al. ..... 399/92
5,419,737 A * 5/1995 Brazell et al. ..... 451/453
5,795,216 A * 8/1998 Graves ..... 451/456
5,803,940 A * 9/1998 Rick et al. ..... 55/490
5,925,172 A * 7/1999 Rick et al. ..... 96/397
5,965,172 A * 10/1999 Wang et al. ..... 425/186
6,049,941 A * 4/2000 Vollenweider, II ..... 15/327.5
6,315,647 B1 * 11/2001 Ghilardi ..... 451/75
6,514,131 B1 * 2/2003 Reich et al. ..... 451/344
6,641,634 B2 * 11/2003 Reich et al. ..... 55/385.1
D504,602 S * 5/2005 Aglassinger et al. ..... D8/62
6,910,960 B2 * 6/2005 Reich et al. ..... 451/451

FOREIGN PATENT DOCUMENTS

GB 2 043 483 10/1980

* cited by examiner

DUST-COLLECTING CONTAINER FOR A HAND ELECTRIC MACHINE TOOL

PRIOR ART

The invention is based on a dust-collecting receptacle for a hand machine tool, in particular an electric hand grinder, according to the preamble to claim 1.

In electric hand grinders, grinding dust is collected in cloth bags, paper bags, or boxes, which have a protruding intake fitting that is fitted onto a dust output fitting on the machine housing. Whereas the paper bags and cloth bags are designed to be expendables that are discarded along with the dust that has been collected, the boxes have a dust-collecting chamber that can be emptied once the box is opened, which allows the dust-collecting receptacle to be reused. The inlet fitting feeds into the dust-collecting chamber and the dust-collecting chamber communicates with an exhaust opening preceded by a dust filter. In the working position of the electric hand grinder, the inlet fitting, the dust-collecting chamber, the filter, and the exhaust opening are situated one after another in spatial sequence.

ADVANTAGES OF THE INVENTION

The dust-collecting receptacle according to the present invention, with the characteristics of claim 1, has the advantage that the integration of the inlet fitting into the dust-collecting receptacle itself and the spatial placement of the inlet fitting, the dust-collecting chamber, the filter, and the exhaust opening one above the other in the working position of the electric hand grinder achieves a compact embodiment of the dust-collecting receptacle with a short structural length and high dust-collecting efficiency. At the same time, the concealed placement of the inlet fitting makes it possible to produce a more attractive dust-collecting receptacle whose outer contours can be adapted to the machine housing in an optimally designed manner.

Advantageous modifications and improvements of the dust-collecting receptacle according to claim 1 are possible by means of the measures taken in the remaining claims.

According to a preferred embodiment of the invention, the mouth of the inlet fitting is located close to the rear delimiting wall of the dust-collecting chamber, at the end facing away from the connecting opening of the inlet fitting and is situated there so that the axis of the mouth is oriented toward the delimiting wall. Because of this structural measure, the dust advantageously enters into the dust-collecting chamber at its rear delimiting wall and is evenly distributed throughout the dust-collecting chamber by the flow of air. The uniformity of the dust distribution is further improved in that, according to a preferred embodiment form of the invention, the exhaust opening and the preceding dust filter extend across the entire top of the dust-collecting chamber.

According to a preferred embodiment of the invention, the dust-collecting chamber is enclosed by a box-like housing that is open at the top and a cover that seals the housing and can be removed from it. The inlet fitting is integrated into the housing bottom and the exhaust opening is situated in the cover. The dust filter is attached to the underside of the cover, preferably by means of ultrasonic welding, and the dust filter is preferably embodied as a folded filter. The inlet fitting is conical and tapers from the connecting opening to the mouth, which has a positive impact on the air speed in the inlet fitting and on the associated transportation of dust.

According to an advantageous embodiment of the invention, locking hooks are provided to engage in corresponding locking recesses in the machine housing. These locking hooks are preferably injection molded in one piece onto the side walls of the housing and protrude out from its end surface oriented toward the machine housing. This structural measure permits the dust-collecting receptacle to be quickly and conveniently detached from and reattached to the machine housing again by means of a simple locking action. Elastic sealing rings, which are situated between the inlet fitting of the dust-collecting receptacle and the dust output fitting of the machine housing, provide a reliable dust seal for the dust-collecting receptacle.

According to an advantageous embodiment of the invention, the cover has an elastic edge with an air-sealing function, which can be placed onto the housing. As a result, the cover supporting the dust filter seals the housing in a dust-tight fashion and can be easily removed from the housing in order to empty the dust-collecting chamber and then be reattached to the housing.

DRAWINGS

The invention will be explained in greater detail below in conjunction with an exemplary embodiment shown in the drawings.

Figure 2:
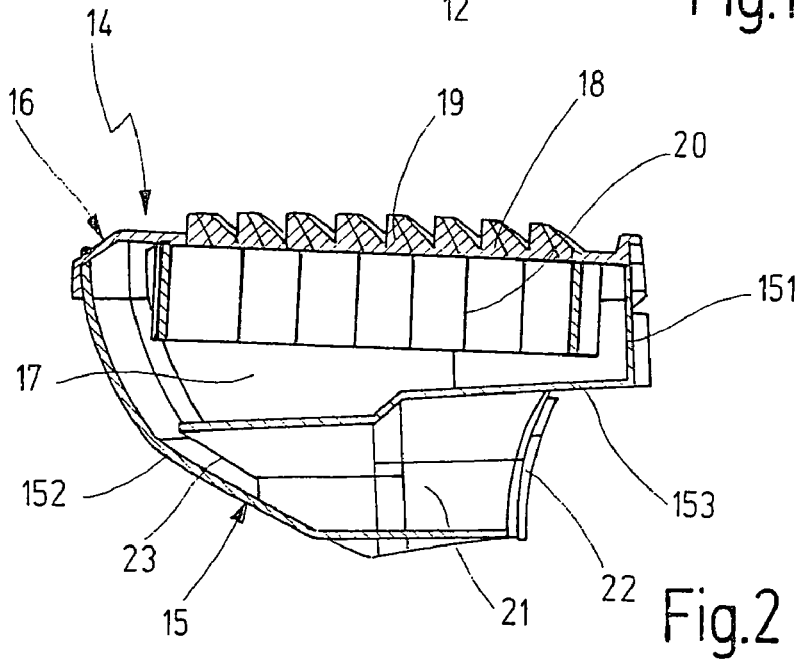
Figure 3:
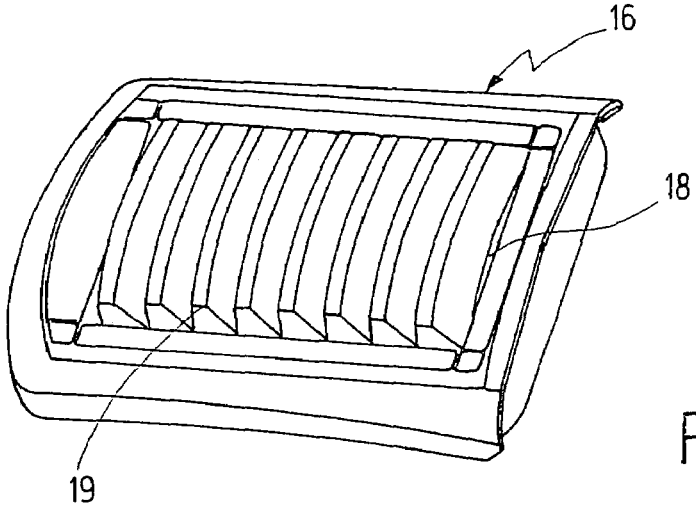
Figure 4:
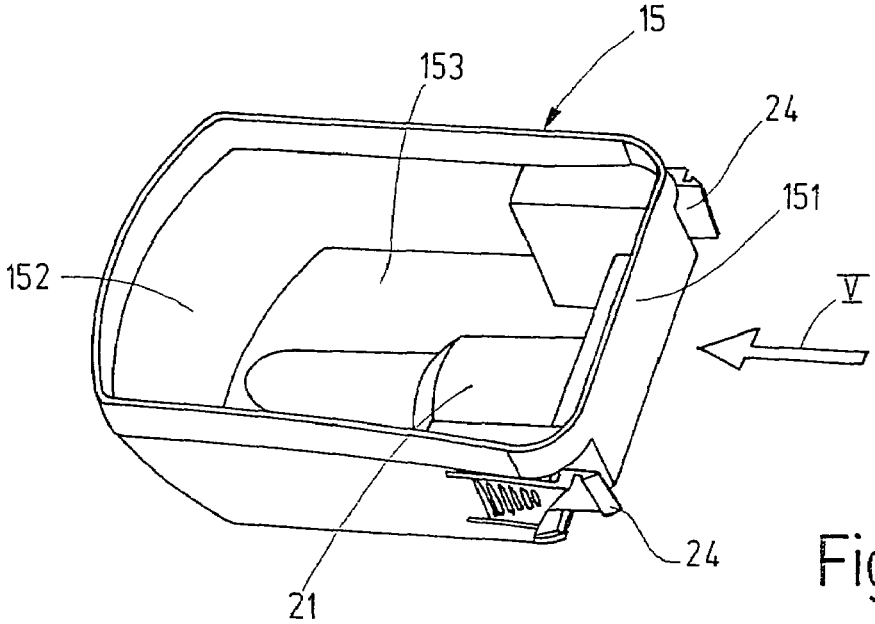
Figure 5:
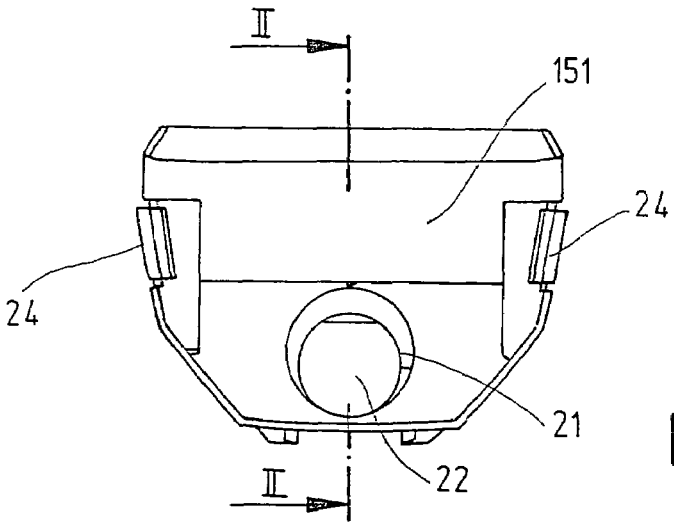

FIG. 1 is a partially sectional side view of an electric hand grinder with a dust-collecting receptacle attached, FIG. 2 is a longitudinal section through the dust-collecting receptacle along the cutting line II-II in FIG. 5, FIG. 3 is a perspective top view of a cover of the dust-collecting receptacle according to FIGS. 1 and 2, FIG. 4 is a perspective top view of a housing of the dust-collecting receptacle according to FIGS. 1 and 2 that can be closed by the cover according to FIG. 3, and FIG. 5 shows a view of the housing in the direction of the arrow V in FIG. 4.

DESCRIPTION OF THE EXEMPLARY EMBODIMENT

The eccentric grinder, a side view of which is shown in FIG. 1 as an exemplary embodiment for an electric hand grinder, has a machine housing 11 whose underside is provided with a backing pad 12 that can be equipped with an abrasive disk and driven to rotate. The grinding dust produced during grinding is sucked through the backing pad 12 by a fan, not shown here, mounted on the drive shaft of the backing pad 12 and is blown out via a dust output fitting 13 that is formed in one piece onto the machine housing 11. A dust-collecting receptacle 14 is slid in a dust-tight fashion onto the dust output fitting 13.

The dust-collecting receptacle 14 detachably fastened to the machine housing 11—which receptacle is shown a partial side view in FIG. 1, a longitudinal section in FIG. 2, and detailed views in FIGS. 3 to 5—has a box-like housing 15 (FIG. 4) that is open at the top and a cover 16 (FIG. 3), which can be placed onto the housing 15, seals the housing 15 in a dust-tight and air-tight fashion and, together with the housing 15, encloses a dust-collecting chamber 17. The cover 16 is provided with an exhaust opening 18 that is covered by a louvered grating 19. When the cover 16 is placed onto the housing 15, the exhaust opening and louvered grating 19 extend over virtually the entire open top of the housing 15. To produce a dust seal, the cover 16 has an elastic edge 161 extending around the outside that has an approximately U-shaped profile and is pressed against the edge of the circumferential end of the housing 15 (FIG. 1).

As is clear from FIGS. 1 and 2, a dust filter 20 is attached to the underside of the cover 16 oriented toward the dust-collecting chamber 17. The dust filter 20 is preferably embodied as a folded filter and is attached to the cover 16 by means of ultrasonic welding. An inlet fitting 21 is integrated into the bottom of the housing 15 and has a connecting opening 22 designed to fit onto the dust output fitting 13 of the machine housing 11 and a mouth 23 oriented toward the dust-collecting chamber 17. The inlet fitting does not extend over a contour of the receptacle. The inlet fitting 21 is conical and tapers cross-sectionally from the connecting opening 22 to the mouth 23. The connecting opening 22 is recessed from the end wall 151 that can be placed against the machine housing 11 and the mouth 23 is situated close to rear housing wall 152 of the housing 15 at the end oriented away from the connecting opening 22, with the axis of the mouth 23 oriented toward the rear housing wall 152.

Like the cover 16, the housing 15 is manufactured of plastic using the injection molding process; the inlet fitting 21 extending along the housing bottom 153 is formed onto the housing 15 as it is being manufactured. Two locking hooks 24 (FIG. 4) are also formed in one piece onto the housing 15, which protrude from the side walls of the housing 15 beyond the front end wall 151 and can engage in correspondingly embodied locking recesses in the machine housing 11.

In order to attach the dust-collecting receptacle 14 to the machine housing 11, the cover 16 with the dust filter 20 underneath it is clamped onto the housing 15 and the complete dust-collecting receptacle 14 thus produced is slid with its bottom inlet fitting 21 onto the dust output fitting 13 of the machine housing 11 until the locking hooks 24 engage in the corresponding locking recesses in the machine housing 11. Annular seals 26, 27 situated in between the inlet fitting 21 and the dust output fitting 13 produce a dust-tight attachment of the dust-collecting receptacle 14 to the dust output fitting 13.

During operation of the electric hand grinder, the dust-laden air flow that the rotating fan in the machine housing 11 sucks through the backing pad 12 and blows out through the dust output fitting 13 is fed into the inlet fitting 21 and enters the dust-collecting chamber 17 close to the rear housing wall 152 of the housing 15. The air flow travels through the dust-collecting chamber 17 and, passing through the dust filter 20, exits the dust-collecting receptacle 14 via the exhaust opening 18. The dust filter 20 retains the dust and the dust settles in the dust-collecting chamber 17. The large-surfaced design of the exhaust opening 18 and the location of the mouth 23 of the inlet fitting 21 assure a largely uniform depositing of the dust in the dust-collecting chamber 17.

As is clear from FIG. 2, the inlet fitting 21, the dust-collecting chamber 17, the dust filter 20, and the outlet opening 18 are situated one above another in the working position of the electric hand grinder, as a result of which the dust-collecting receptacle 14 is very compact and does not hinder the operation of the electric hand grinder or impair it in any other way. The dust-collecting receptacle 14 attaches to the machine housing 11 in a secure and reliable fashion thanks to the locking hooks 24 and the way that the front end wall 151 of the housing 15 is designed to rest against the machine housing 11 in a form-locked fashion when the locking hooks 24 engage. If the form of the housing 15 with the cover 16 is also adapted to the outer contours of the machine housing 11, then this yields an optimally designed unit comprised of the electric hand grinder and dust-collecting receptacle 14.

The dust-collecting receptacle 14 described above is suitable not only for use with the electric hand grinder described, but also with any electric hand machine tool for material-removing machining of work pieces in which material is removed from the work piece as the work piece is machined. Other examples of such electric hand machine tools include electric hand planes or electric hand saws.

What is claimed is:

1. A dust-collecting receptacle for an electric hand machine tool, in particular an electric hand grinder, having a dust-collecting chamber (17), having an inlet fitting (21) that has a connecting opening (22) to be fitted onto a dust output fitting (13) of the machine and a mouth (23) oriented toward the dust-collecting chamber (17), having an exhaust opening (18), and having a dust filter (20) situated between the dust-collecting chamber (17) and the exhaust opening (18), wherein the inlet fitting (21) extends only inside the receptacle in a lower region of the receptacle and does not extend over a contour of the receptacle and extends below the dust collecting chamber (17) and below the dust filter (20) and exhaust opening (18), so that an upper region of the inlet fitting (21) forms a bottom portion of the dust-collecting chamber (17), and wherein the mouth (23) of the inlet fitting (21) is situated close to a rear delimiting wall (152) of the dust-collecting chamber (17), wherein said rear delimiting wall (152) is oriented to the axis of the inlet fitting (21) with an angle of less than 90° to form a slope to guide an incoming airstream upwards into the dust collecting chamber (17).

2. The receptacle as recited in claim 1, wherein the dust-collecting chamber (17) extends beyond the connecting fitting (23) of the inlet fitting (21).

3. The receptacle as recited in one of claim 1, wherein the dust-collecting chamber (17) is enclosed by a box-shaped housing (15) that is open at the top and a cover (16) that closes the housing (15), the inlet fining (21) is integrated into the housing bottom (153), and the exhaust opening (18) is situated in the cover (16).

4. The receptacle as recited in claim 3, wherein the exhaust opening (18) extends over the entire cover (16) and is covered by a louvered grating (19).

5. The receptacle as recited in claim 3, wherein the dust filter (20) is attached to the underside of the cover (16), preferably by means of ultrasonic welding.

6. The receptacle as recited in claim 3, wherein the cover (16) has an elastic edge extending around the outside, which rests against the housing (15) and has an air-sealing function.

7. The receptacle as recited in claim 3, wherein the housing (15) is provided with locking hooks (24) that engage in corresponding locking recesses provided on the machine.

8. The receptacle as recited in claim 3, wherein the housing (15) with the cover (16) is adapted to the outer contours of the machine.

9. The receptacle as recited in claim 7, wherein the end wall (151) of the housing (15) bounded by the locking hooks (24) is designed to rest against the machine in a form-locked manner.

10. The receptacle as recited in claim 1, wherein the dust filter (20) and exhaust opening (18) are situated one above the other on top of the dust-collecting chamber (17).

* * * * *